US012663170B2

(12) United States Patent
Nakano et al.

(10) Patent No.: US 12,663,170 B2
(45) Date of Patent: Jun. 23, 2026

(54) AIR CONDITIONER INDOOR UNIT AND AIR CONDITIONER

(71) Applicant: DAIKIN INDUSTRIES, LTD., Osaka (JP)

(72) Inventors: Hiroyuki Nakano, Osaka (JP); Atsushi Yamamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 79 days.

(21) Appl. No.: 18/583,090

(22) Filed: Feb. 21, 2024

(65) Prior Publication Data

US 2024/0230112 A1 Jul. 11, 2024

Related U.S. Application Data

(63) Continuation of application No. PCT/JP2022/022526, filed on Jun. 2, 2022.

(30) Foreign Application Priority Data

Sep. 30, 2021 (JP) ..... 2021-161951

(51) Int. Cl.
*F24F 1/26* (2011.01)
*F24F 1/0059* (2019.01)
*F25B 41/40* (2021.01)

(52) U.S. Cl.
CPC ..... *F24F 1/26* (2013.01); *F24F 1/0059* (2013.01); *F25B 41/40* (2021.01); *F25B 2500/01* (2013.01)

(58) Field of Classification Search
CPC ..... F24F 1/26; F24F 1/0063; F24F 1/0068; F28F 9/0246; F28F 21/084
See application file for complete search history.

(56) References Cited

U.S. PATENT DOCUMENTS 5,284,204 A * 2/1994 Morgan ..... F16L 11/22 236/38
6,273,477 B1 * 8/2001 Ohmi ..... F16L 19/0212 277/541

(Continued)

FOREIGN PATENT DOCUMENTS

CN 102209870 A 10/2011
EP 2 347 197 A1 7/2011

(Continued)

OTHER PUBLICATIONS

International Search Report (PCT/ISA/210) issued in PCT/JP2022/022526, dated Aug. 16, 2022.

(Continued)

*Primary Examiner* — Lionel Nouketcha
(74) *Attorney, Agent, or Firm* — Birch, Stewart, Kolasch & Birch, LLP

(57) ABSTRACT

An indoor unit of an air conditioner includes a heat transfer tube and a connection pipe. The connection pipe includes a first connection pipe a liquid pipe and a second connection pipe as a gas pipe. The first connection pipe and the second connection pipe each have a first section and a second section. A contact prevention member is provided in an area where the second section of the first connection pipe and the first section of the second connection pipe approach each other, or in an area where the first section of the first connection pipe and the second section of the second connection pipe approach each other.

13 Claims, 10 Drawing Sheets

(56) References Cited

U.S. PATENT DOCUMENTS

| | | | | |
|---|---|---|---|---|
| 2015/0040446 | A1* | 2/2015 | Nakasu | G09F 3/10 40/625 |
| 2015/0345845 | A1* | 12/2015 | Nakatsu | F25B 45/00 62/77 |
| 2018/0283703 | A1* | 10/2018 | Hong | F24F 1/0067 |

FOREIGN PATENT DOCUMENTS

| | | | | |
|---|---|---|---|---|
| EP | 2620736 | A2 * | 7/2013 | F28F 19/02 |
| EP | 3 101 353 | A1 | 12/2016 | |
| JP | 2002276970 | A * | 9/2002 | |
| JP | 2014-167376 | A | 9/2014 | |
| JP | 2015-140998 | A | 8/2015 | |
| JP | 2019-124440 | A | 7/2019 | |

OTHER PUBLICATIONS

International Preliminary Report on Patentability and English translation of the Written Opinion of the International Searching Authority for International Application No. PCT/JP2022/022526, dated Apr. 11, 2024.

Extended European Search Report for European Application No. 22875458.6, dated Oct. 21, 2024.

* cited by examiner

AIR CONDITIONER INDOOR UNIT AND AIR CONDITIONER

CROSS REFERENCE TO RELATED APPLICATIONS

This application is a Continuation of PCT International Application No. PCT/JP2022/022526, filed on Jun. 2, 2022, which claims priority under 35 U.S.C. 119(a) to Patent Application No. 2021-161951, filed in Japan on Sep. 30, 2021, all of which are hereby expressly incorporated by reference into the present application.

TECHNICAL FIELD

The present disclosure relates to an indoor unit of an air conditioner and the air conditioner.

BACKGROUND ART

Patent Document 1 discloses an indoor unit of an air conditioner. The indoor unit includes a liquid pipe and a gas pipe. The liquid pipe and the gas pipe each have a first pipe section made of aluminum or an aluminum alloy and having one end connected to an indoor heat exchanger; a second pipe section made of copper or a copper alloy and having one end connected to the other end of the first pipe section; and a flare union connected to the other end of the second pipe section.

CITATION LIST

Patent Document

Patent Document 1: Japanese Unexamined Patent Publication No. 2015-140998

SUMMARY

A first aspect of the present disclosure is directed to an indoor unit of an air conditioner. The indoor unit includes a heat transfer tube (36) of a heat exchanger (30); and a connection pipe (3) which is connected to the heat transfer tube (36) and through which a refrigerant flowing out of the heat transfer tube (36) or a refrigerant flowing into the heat transfer tube (36) passes. The connection pipe (3) includes a first connection pipe (32) as a liquid pipe and a second connection pipe (33) as a gas pipe. (i) The first connection pipe (32) includes a first section made of a first metal with no potential difference from the heat transfer tube (36), and the second connection pipe (33) including a second section made of a second metal with a different potential from the first section, or (ii) the second connection pipe (33) includes a first section made of a first metal with no potential difference from the heat transfer tube (36), and the first connection pipe (32) including a second section made of a second metal with a different potential from the first section. A contact prevention member (40) for preventing contact between the first connection pipe (32) and the second connection pipe (33) is provided in an area where the second section of the first connection pipe (32) and the first section of the second connection pipe (33) approach each other, or in an area where the first section of the first connection pipe (32) and the second section of the second connection pipe (33) approach each other.

DESCRIPTION OF EMBODIMENT

An embodiment will be described. This embodiment provides an air conditioner (10) for conditioning the air in an indoor space.

General Configuration of Air Conditioner

Figure 1:
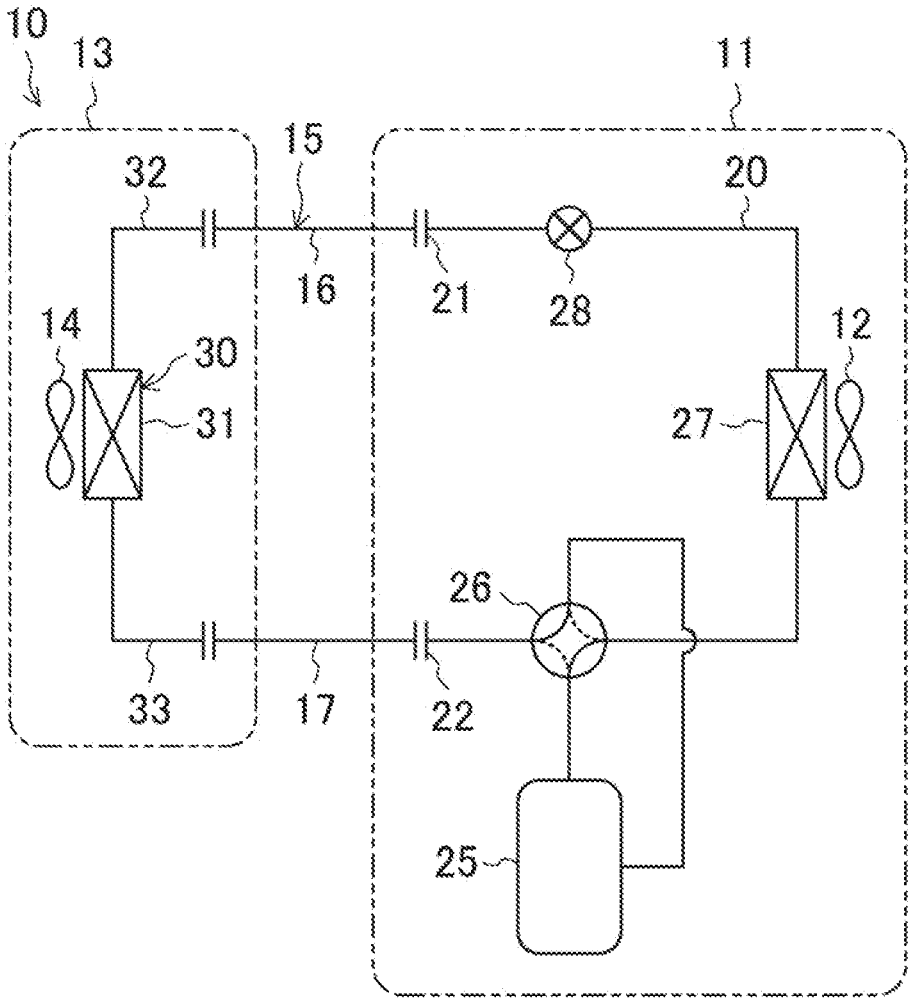
FIG. 1 is a piping system diagram showing a configuration of an air conditioner according to an embodiment.
Figure 2:
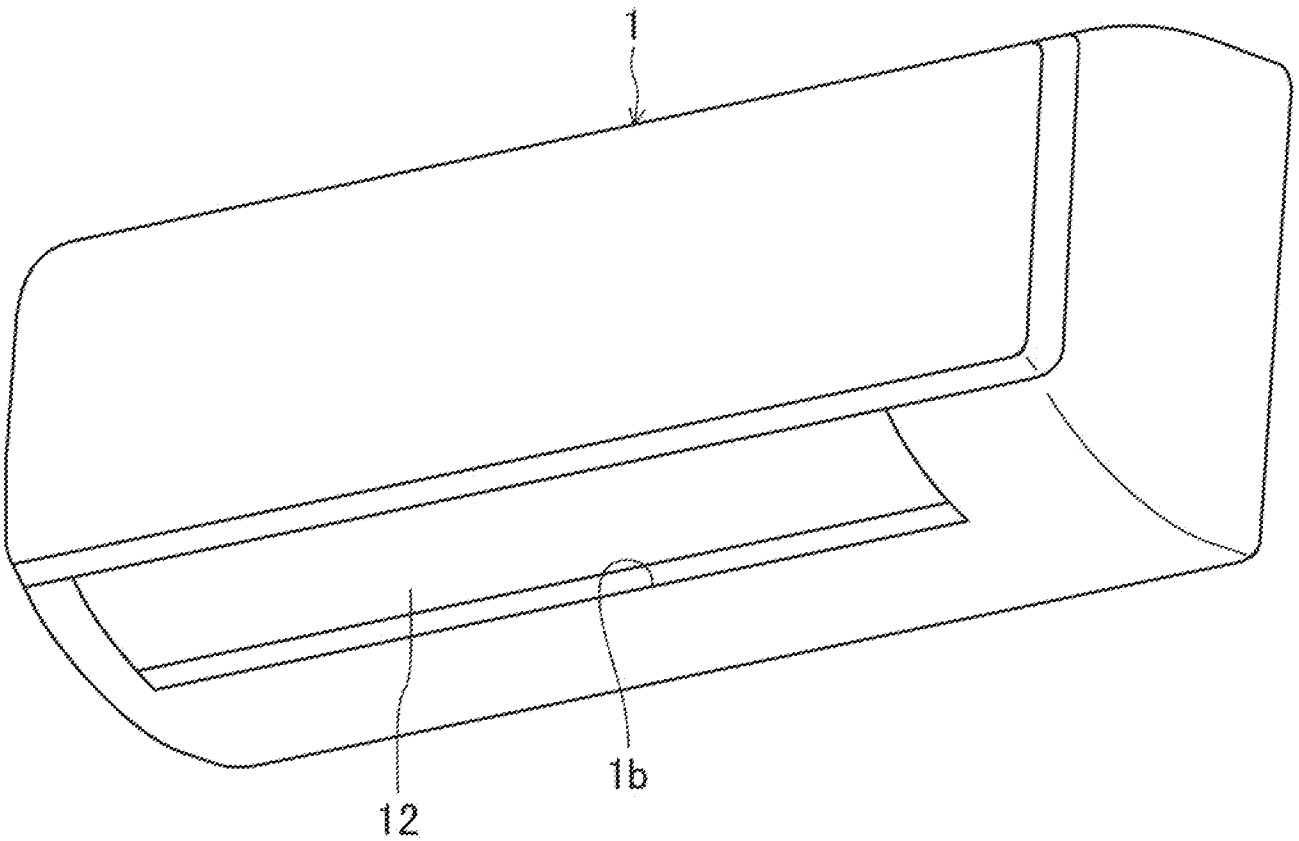
FIG. 2 is a perspective view of the front of a casing of an indoor unit.

As shown in FIG. 1, the air conditioner (10) includes an outdoor unit (11) and an indoor unit (13). The outdoor unit (11) includes a casing (110) that houses an outdoor circuit (20) and an outdoor fan (12). The indoor unit (13) includes a casing (130) that houses an indoor heat exchanger (30) and an indoor fan (14). The outdoor unit (11) and the indoor unit (13) are connected to each other via a liquid connection pipe (16) and a gas connection pipe (17) and constitute a refrigerant circuit (15).

Refrigerant Circuit

The outdoor circuit (20) includes a compressor (25), a four-way switching valve (26), an outdoor heat exchanger (27), and an expansion valve (28). In the outdoor circuit (20), the compressor (25) includes a discharge pipe and a suction pipe connected to the four-way switching valve (26). The outdoor circuit (20) has a gas end (22) connected to the four-way switching valve (26). In the outdoor circuit (20), the expansion valve (28) and the outdoor heat exchanger (27) are arranged in this order from a liquid end (21) of the outdoor circuit (20) toward the four-way switching valve (26).

The liquid end (21) of the outdoor circuit (20) is connected to one end of the liquid connection pipe (16) via a joint. The gas end (22) of the outdoor circuit (20) is connected to one end of the gas connection pipe (17) via a joint.

The compressor (25) is of a hermetic type. The outdoor heat exchanger (27) is what is called a "cross-fin heat exchanger," and causes the refrigerant in the refrigerant circuit (15) to exchange heat with outdoor air. The expansion valve (28) is what is called an "electronic expansion valve." The four-way switching valve (26) is a switching valve for switching between cooling operation and heating operation.

The indoor heat exchanger (30) includes a main body (31), a liquid pipe (32), and a gas pipe (33). The main body (31) is what is called a "cross-fin heat exchanger," and causes the refrigerant in the refrigerant circuit (15) to exchange heat with indoor air. The main body (31) is connected to one end of the liquid pipe (32) and one end of the gas pipe (33).

Figure 4:
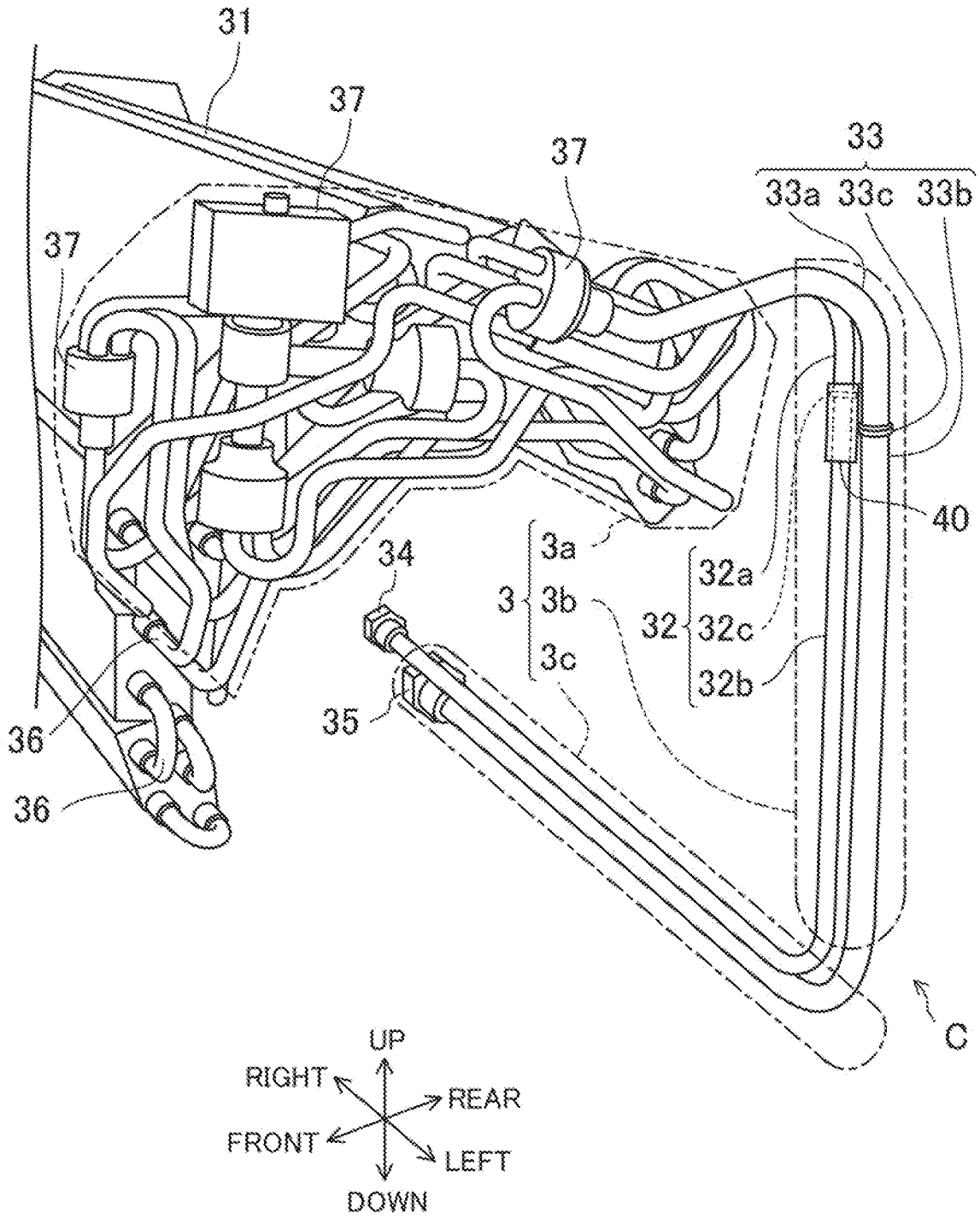
FIG. 4 is a perspective view of an indoor heat exchanger.

The other end of the liquid pipe (32) is connected to the other end of the liquid connection pipe (16) via a joint (34) (see FIG. 4). The other end of the gas pipe (33) is connected to the other end of the gas connection pipe (17) via a joint (35) (see FIG. 4). The liquid pipe (32) has a diameter smaller than that of the gas pipe (33).

Operation of Air Conditioner

The air conditioner (10) selectively performs cooling operation and heating operation. In each of the cooling and heating operations, the air conditioner (10) circulates the refrigerant in the refrigerant circuit (15) to perform a refrigeration cycle.

In the cooling operation, the four-way switching valve (26) is in the state indicated by the solid line in FIG. 1, the outdoor heat exchanger (27) functions as a condenser, and the indoor heat exchanger (30) functions as an evaporator. The indoor unit (13) cools the sucked indoor air in the main body (31) of the indoor heat exchanger (30), and blows the cooled indoor air into a room.

In the heating operation, the four-way switching valve (26) is in the state indicated by the broken line in FIG. 1, the indoor heat exchanger (30) functions as a condenser, and the outdoor heat exchanger (27) functions as an evaporator. The indoor unit (13) heats the sucked indoor air in the main body (31) of the indoor heat exchanger (30), and blows the heated indoor air into the room.

Indoor Unit

The indoor unit (13) will be described. A top part of the casing (130) of the indoor unit (13) is provided with an inlet (131) for sucking indoor air. A bottom part of the casing (130) is provided with an outlet (132). The air that has passed through the indoor heat exchanger (30) in the casing (130) is blown outside of the casing (130) through the outlet (132). The outlet (132) is attached with a wind vane (133). At a downstream side of the indoor heat exchanger (30) and an upstream side of the outlet (132), a cross-flow fan (not shown) is provided.

Configurations of the indoor heat exchanger (30) and the periphery of the indoor heat exchanger (30) will be described. The indoor heat exchanger (30) includes a plurality of heat transfer tubes (36) penetrating the main body (31), and a flow divider (37) for dividing the liquid pipe (32) or the gas pipe (33). The main body (31) and the heat transfer tubes (36) are made of aluminum, for example. Any of the heat transfer tubes (36) is/are connected with the liquid pipe (32), while the other(s) of the heat transfer tubes (36) is/are connected with the gas pipe (33).

Casing

Figure 3:
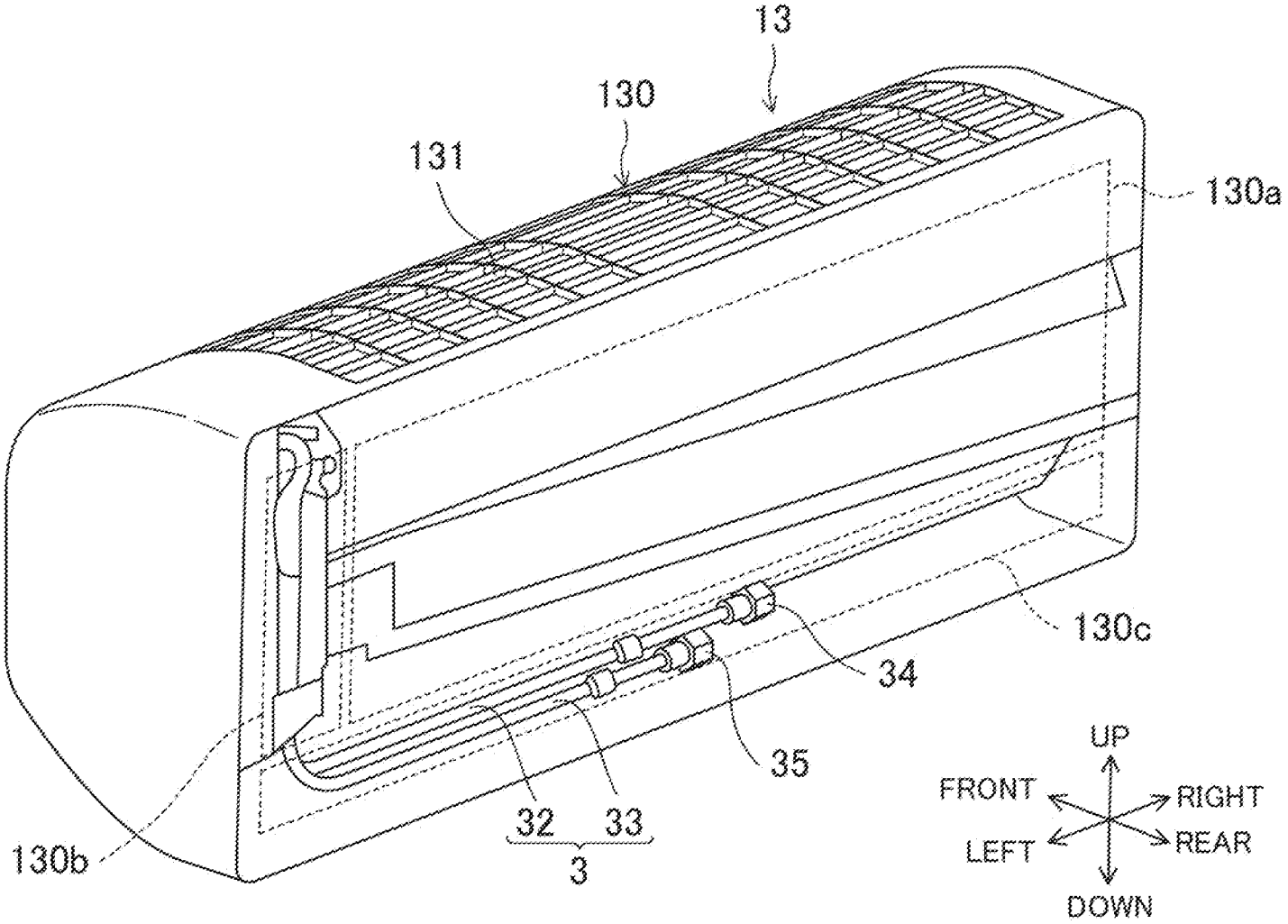
FIG. 3 is a perspective view of the rear of the casing of the indoor unit.

As shown in FIG. 3, the casing (130) contains a first space (130*a*) and a second space (130*b*). The first space (130*a*) is the main area in the casing (130). In the first space (130*a*), the main body (31) and the heat transfer tubes (36) of the indoor heat exchanger (30) are arranged. The second space (130*b*) communicates with the first space (130*a*). The second space (130*b*) is provided on a side of the first space (130*a*) and extends vertically. A third space (130*c*) is formed outside the casing (130). The third space (130*c*) is provided between the rear bottom of the first space (130*a*) and a wall surface on which the casing (130) is placed. The third space (130*c*) communicates with the second space (130*b*). The third space (130*c*) extends transversely from the bottom of the second space (130*b*). The third space (130*c*) is a piping space used for arranging various tubular members, such as the liquid pipe (32), the gas pipe (33), and a path (e.g., a hose) for discharging condensed water.

Contact Prevention Member

The indoor unit (13) includes a contact prevention member (40). The contact prevention member (40) is a member for preventing contact between the sections of the liquid pipe (32) and the gas pipe (33) made of different types of metals. The contact prevention member (40) is made of an insulating material. The contact prevention member (40) has a substantially cylindrical shape. The contact prevention member (40), when the liquid pipe (32) or the gas pipe (33) is inserted therein, covers a part of the liquid pipe (32) or a part of the gas pipe (33). The contact prevention member (40) may be an insulating coating that is applied so as to cover a part of the liquid pipe (32) or a part of the gas pipe (33).

Connection Pipe

In the following, the liquid pipe (32) and the gas pipe (33) may be collectively referred to as a "connection pipe (3)." The connection pipe (3) is placed in the casing (130) extending from the heat transfer tubes (36) of the first space (130*a*) along the second space (130*b*) and the third space (130*c*).

The connection pipe (3) includes a connector (3*a*), a falling section (3*b*), and a lying section (3*c*). The connector (3*a*) is provided in the first space (130*a*). The connector (3*a*) is connected to the heat transfer tubes (36). The falling section (3*b*) is provided in the second space (130*b*). The falling section (3*b*) is connected to the connector (3*a*) and extends downward from the connecting point with the connector (3*a*). The lying section (3*c*) is provided in the third space (130*c*). The lying section (3*c*) is connected to the bottom of the falling section (3*b*) and extends transversely from the connecting point with the falling section (3*b*).

Liquid Pipe

The liquid pipe (32) includes a first liquid pipe section (32*a*), a second liquid pipe section (32*b*), and a liquid pipe connector (32*c*). The first liquid pipe section (32*a*) is made of aluminum or an aluminum alloy, for example. The second liquid pipe section (32*b*) is made of copper or a copper alloy, for example. Out of the first liquid pipe section (32*a*) and the second liquid pipe section (32*b*), the first liquid pipe section (32*a*) is closer to the heat transfer tubes (36). The first liquid pipe section (32*a*) is made of a metal with no potential difference from the heat transfer tubes (36). The second liquid pipe section (32*b*) is made of a metal with a different potential from the first liquid pipe section (32*a*). The second liquid pipe section (32*b*) is made of a metal with more noble potential than the first liquid pipe section (32*a*). The liquid pipe connector (32*c*) shows a connecting point between the first liquid pipe section (32*a*) and the second liquid pipe section (32*b*).

Gas Pipe

The gas pipe (33) includes a first gas pipe section (33*a*), a second gas pipe section (33*b*), and a gas pipe connector (33*c*). The first gas pipe section (33*a*) is made of aluminum or an aluminum alloy, for example. The second gas pipe section (33*b*) is made of copper or a copper alloy, for example. Out of the first gas pipe section (33*a*) and the second gas pipe section (33*b*), the first gas pipe section (33*a*) is closer to the heat transfer tubes (36). The first gas pipe section (33*a*) is made of a metal with no potential difference from the heat transfer tubes (36). The second gas pipe section (33*b*) is made of a metal with a different potential from the first gas pipe section (33*a*). The second gas pipe section (33*b*) is made of a metal with more noble potential than the first gas pipe section (33*a*). The gas pipe connector (33*c*) shows a connecting point between the first gas pipe section (33*a*) and the second gas pipe section (33*b*).

Comparison Between Configurations of Liquid and Gas Pipes

The first liquid pipe section (32*a*) is made of a metal with no potential difference from the first gas pipe section (33*a*). The second liquid pipe section (32*b*) is made of a metal with no potential difference from the second gas pipe section (33*b*).

The second liquid pipe section (32*b*) is made of a metal with a different potential from the first gas pipe section (33*a*). In this embodiment, the metal with a different potential has noble potential. The second gas pipe section (33*b*) is made of a metal with a different potential from the first liquid pipe section (32*a*).

Approach Area

Figure 5A:
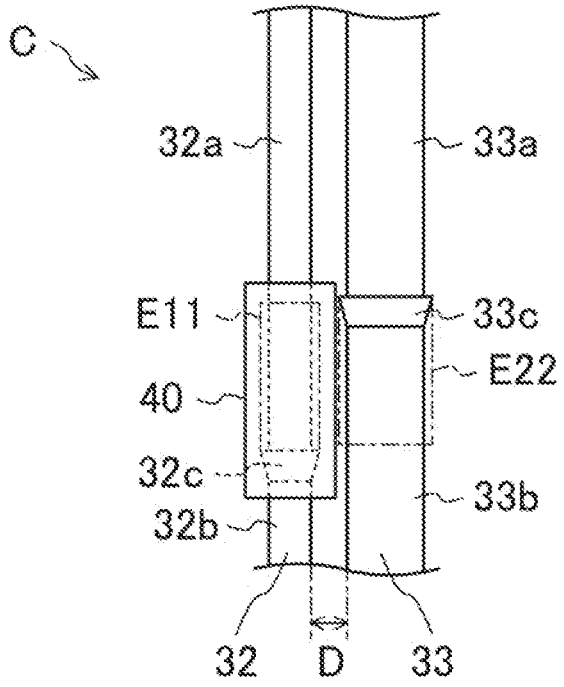
FIGS. 5A and 5B show the location of a contact prevention member.

In the following, as shown in FIG. 5A, an area where the liquid pipe (32) and the gas pipe (33) approach each other and are parallel to each other at a predetermined distance (D) may be referred to as an "approach area (C)." The predetermined distance (D) is 15 mm or less, preferably 10 mm or less, and more preferably 5 mm or less. In the approach area (C), the liquid pipe (32) and the gas pipe (33) are substantially parallel to each other.

As shown in FIG. 4, in this embodiment, the approach area (C) extends from the falling section (3*b*) to the lying section (3*c*).

Parallel Section

Figure 5B:
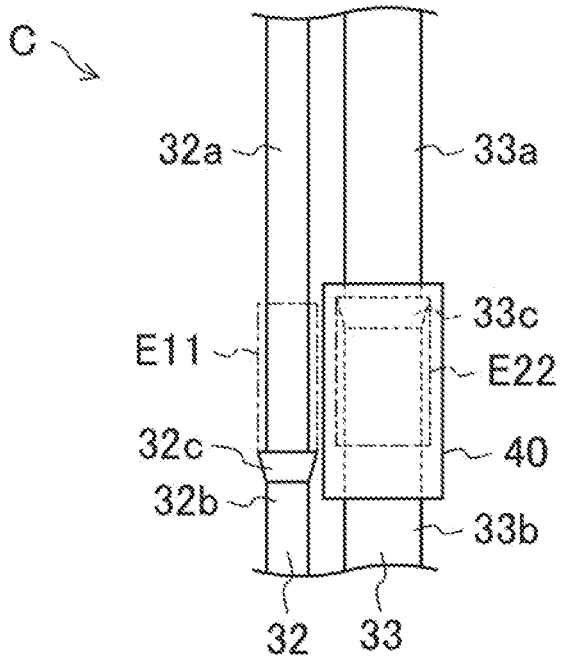

In the approach area (C), a section of the first liquid pipe section (32*a*) of the liquid pipe (32), which is parallel to the second gas pipe section (33*b*) of the gas pipe (33), may be referred to as a "first liquid pipe parallel section (E11)" (see FIGS. 5A and 5B).

Figure 6A:
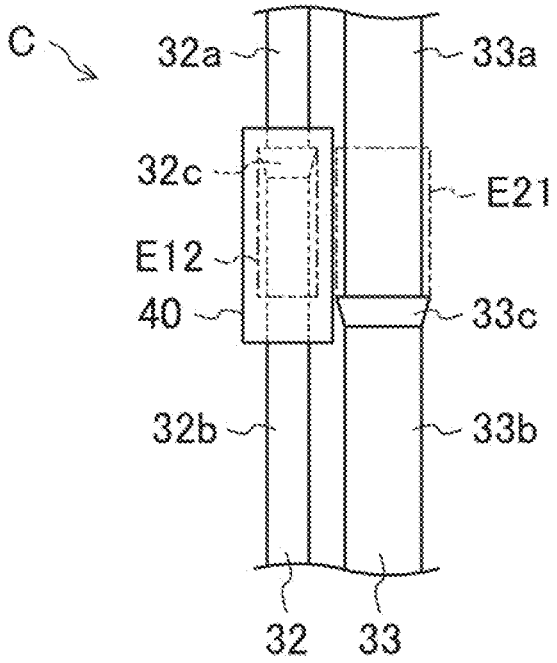
FIGS. 6A and 6B show a first variation of the location of the contact prevention member.
Figure 6B:
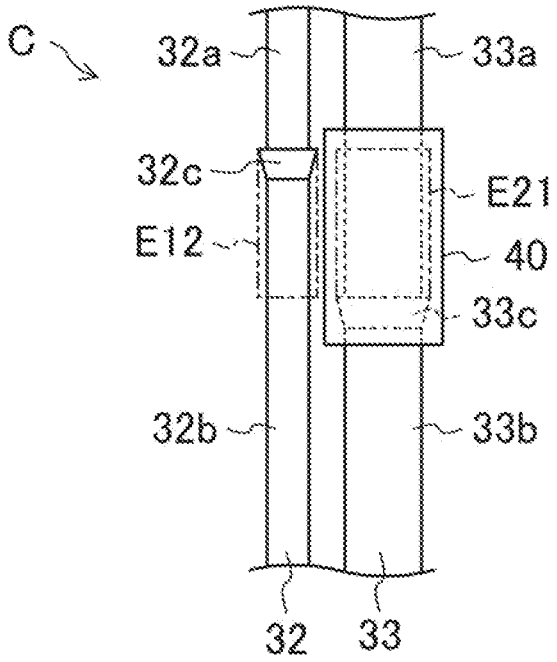

In the approach area (C), a section of the second liquid pipe section (32*b*) of the liquid pipe (32), which is parallel to the first gas pipe section (33*a*) of the gas pipe (33), may be referred to as a "second liquid pipe parallel section (E12)" (see FIGS. 6A and 6B).

In the approach area (C), a section of the first gas pipe section (33*a*) of the gas pipe (33), which is parallel to the second liquid pipe section (32*b*) of the liquid pipe (32), may be referred to as a "first gas pipe parallel section (E21)" (see FIGS. 6A and 6B).

In the approach area (C), a section of the second gas pipe section (33*b*) of the gas pipe (33), which is parallel to the first liquid pipe section (32*a*) of the liquid pipe (32), may be referred to as a "second gas pipe parallel section (E22)" (see FIGS. 5A and 5B).

Configuration According to This Embodiment

As shown in FIG. 5A, in this embodiment, the first liquid pipe parallel section (E11) and the second gas pipe parallel section (E22) are parallel to each other in the approach area (C). In this embodiment, out of the first liquid pipe parallel section (E11) and the second gas pipe parallel section (E22), the first liquid pipe parallel section (E11) is covered with the contact prevention member (40). As shown in FIG. 5B, out of the first liquid pipe parallel section (E11) and the second gas pipe parallel section (E22), the second gas pipe parallel section (E22) may be covered with the contact prevention member (40). FIGS. 5A and 5B show examples of the configuration (i) according to the present invention. In the configuration (i), the contact prevention member (40) for preventing contact between the first connection pipe (32) and the second connection pipe (33) is provided in the area where the first section (the first liquid pipe parallel section (E11)) of the first connection pipe (32) and the second section (the second gas pipe parallel section (E22)) of the second connection pipe (33) approach each other.

First Variation

As shown in FIG. 6A, the second liquid pipe parallel section (E12) and the first gas pipe parallel section (E21) are parallel to each other in the approach area (C). In this variation, out of the second liquid pipe parallel section (E12) and the first gas pipe parallel section (E21), the second liquid pipe parallel section (E12) is covered with the contact prevention member (40). As shown in FIG. 6B, out of the second liquid pipe parallel section (E12) and the first gas pipe parallel section (E21), the first gas pipe parallel section (E21) may be covered with the contact prevention member (40). FIGS. 6A and 6B show examples of the configuration (ii) according to the present invention. In the configuration (ii), the contact prevention member (40) is provided in the area where the second section (the second liquid pipe parallel section (E12)) of the first connection pipe (32) and the first section (the first gas pipe parallel section (E21)) of the second connection pipe (33) approach each other.

Second Variation

Figure 7:
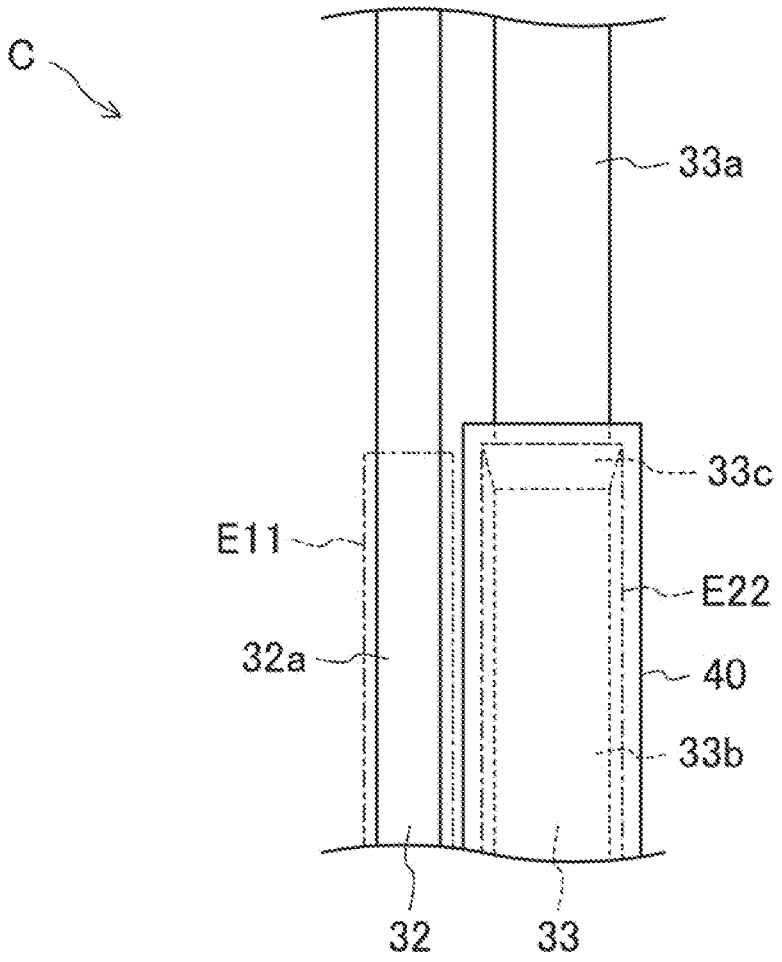
FIG. 7 shows a second variation of the location of the contact prevention member.

As shown in FIG. 7, the liquid pipe (32) in the approach area (C) may include only the first liquid pipe section (32*a*). In this case, in the approach area (C), the first liquid pipe parallel section (E11) and the second gas pipe parallel section (E22) are parallel to each other. In the second variation, out of the first liquid pipe parallel section (E11) and the second gas pipe parallel section (E22), the second gas pipe parallel section (E22) is covered with the contact prevention member (40). Out of the first liquid pipe parallel section (E11) and the second gas pipe parallel section (E22), the first liquid pipe parallel section (E11) may be covered with the contact prevention member (40). FIG. 7 shows an example of the configuration (i) according to the present invention.

Third Variation

Figure 8:
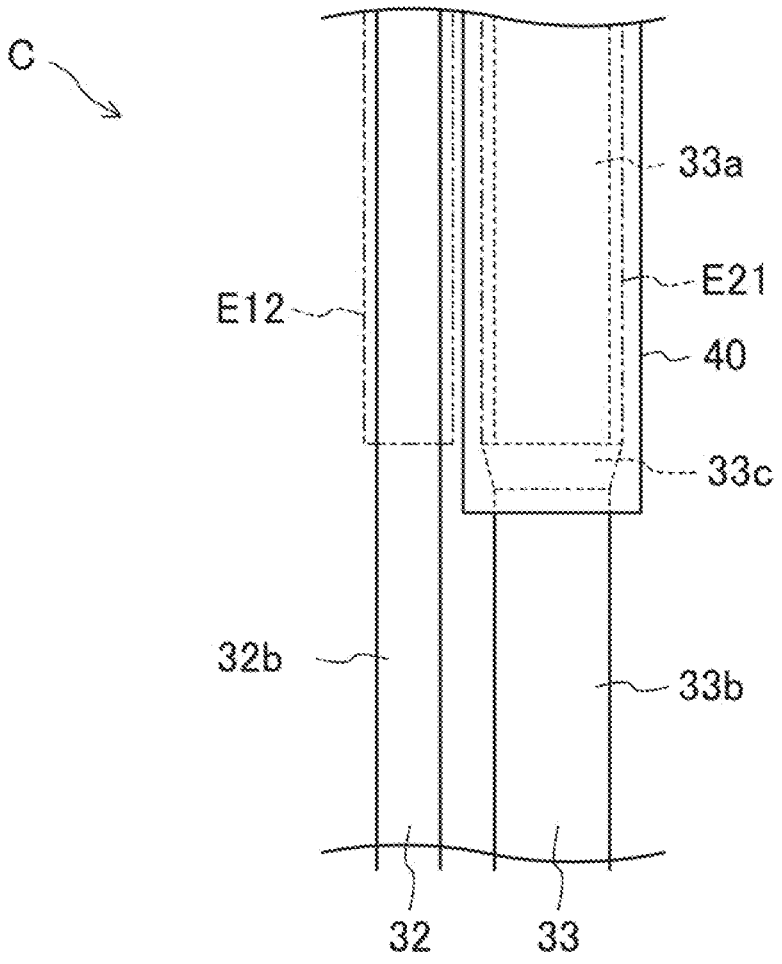
FIG. 8 shows a third variation of the location of the contact prevention member.

As shown in FIG. 8, the liquid pipe (32) in the approach area (C) may include only the second liquid pipe section (32*b*). In this case, in the approach area (C), the second liquid pipe parallel section (E12) and the first gas pipe parallel section (E21) are parallel to each other. In the third variation, out of the second liquid pipe parallel section (E12)

and the first gas pipe parallel section (E21), the first gas pipe parallel section (E21) is covered with the contact prevention member (40). Out of the second liquid pipe parallel section (E12) and the first gas pipe parallel section (E21), the second liquid pipe parallel section (E12) may be covered with the contact prevention member (40). FIG. 8 shows an example of the configuration (ii) according to the present invention.

Fourth Variation

Figure 9:
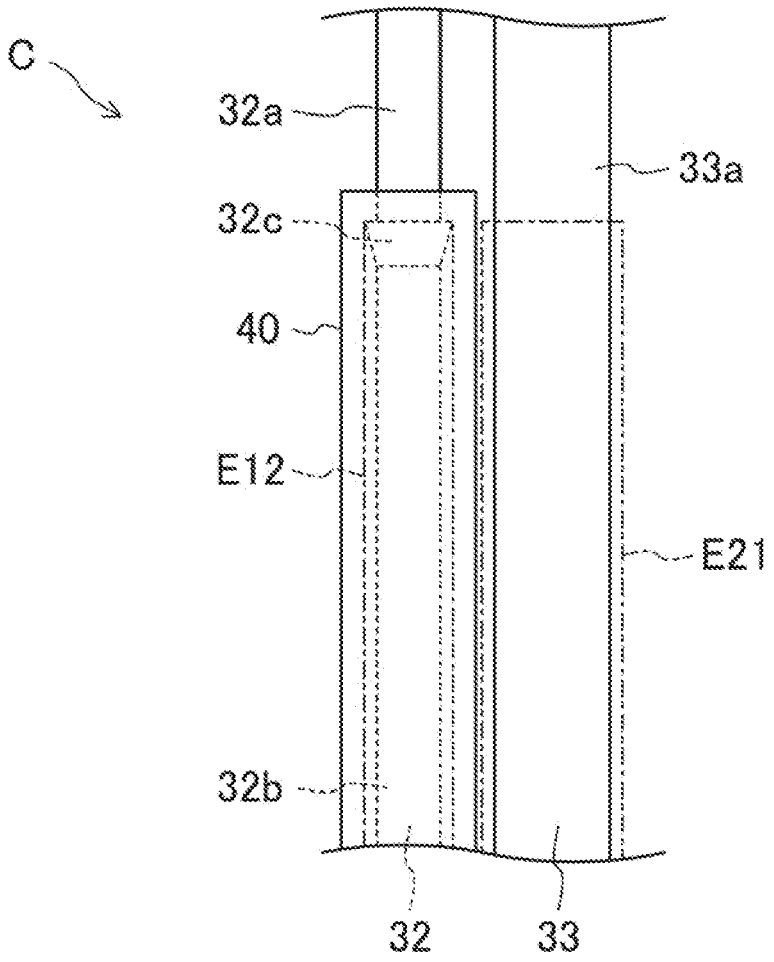
FIG. 9 shows a fourth variation of the location of the contact prevention member.

As shown in FIG. 9, the gas pipe (33) in the approach area (C) may include only the first gas pipe section (33*a*). In this case, in the approach area (C), the second liquid pipe parallel section (E12) and the first gas pipe parallel section (E21) are parallel to each other. In the fourth variation, out of the second liquid pipe parallel section (E12) and the first gas pipe parallel section (E21), the second liquid pipe parallel section (E12) is covered with the contact prevention member (40). Out of the second liquid pipe parallel section (E12) and the first gas pipe parallel section (E21), the first gas pipe parallel section (E21) may be covered with the contact prevention member (40). FIG. 9 shows an example of the configuration (ii) according to the present invention.

Fifth Variation

Figure 10:
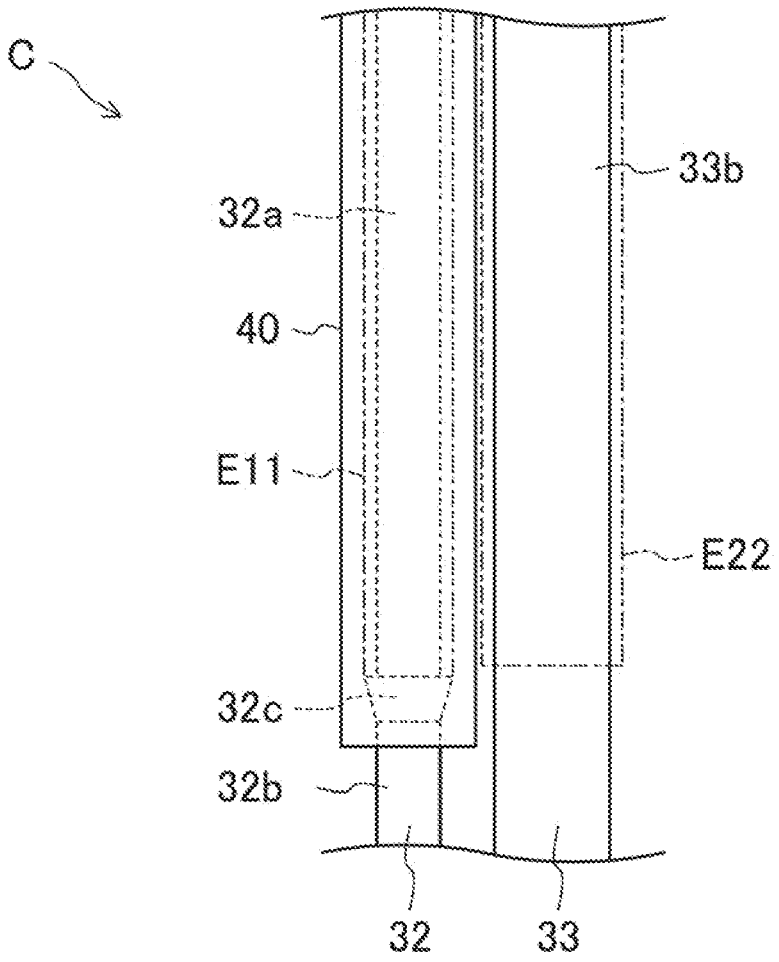
FIG. 10 shows a fifth variation of the location of the contact prevention member.

As shown in FIG. 10, the gas pipe (33) in the approach area (C) may include only the second gas pipe section (33*b*). In this case, in the approach area (C), the first liquid pipe parallel section (E11) and the second gas pipe parallel section (E22) are parallel to each other. In the fifth variation, out of the first liquid pipe parallel section (E11) and the second gas pipe parallel section (E22), the first liquid pipe parallel section (E11) is covered with the contact prevention member (40). Out of the first liquid pipe parallel section (E11) and the second gas pipe parallel section (E22), the second gas pipe parallel section (E22) may be covered with the contact prevention member (40). FIG. 10 shows an example of the configuration (i) according to the present invention.

Advantages

As described above, the contact prevention member (40) for preventing contact between the liquid pipe (32) and the gas pipe (33) is provided in the area where the second liquid pipe section (32*b*) of the liquid pipe (32) and the first gas pipe section (33*a*) of the gas pipe (33) approach each other or in the area where the first liquid pipe section (32*a*) of the liquid pipe (32) and the second gas pipe section (33*b*) of the gas pipe (33) approach each other. Accordingly, there is less contact between the sections of the liquid pipe (32) and the gas pipe (33) made of different types of metals (copper and aluminum). As a result, there is less galvanic corrosion in the copper section with more noble potential than aluminum, in the liquid pipe (32) and the gas pipe (33).

The contact prevention member (40) is provided at a place where the liquid pipe (32) and the gas pipe (33) are substantially parallel to each other. The liquid pipe (32) and the gas pipe (33) arranged in parallel use a larger contact area than the liquid pipe (32) and the gas pipe (33) intersecting with each other, thus there is larger piping area where galvanic corrosion may occur. However, the contact prevention member (40) can cover the pipe area, and this effectively reduces the galvanic corrosion of the piping area.

In the falling section (3*b*) of the connection pipe (3), the first liquid pipe section (32*a*) and the second liquid pipe section (32*b*) are connected to each other, and the first gas pipe section (33*a*) and the second gas pipe section (33*b*) are connected to each other. Since the space in the casing (130) of the indoor unit (13) is limited, it is difficult to secure a space for connecting different types of metals (the first liquid pipe section (32*a*) and the second liquid pipe section (32*b*), and the first gas pipe section (33*a*) and the second gas pipe section (33*b*)). However, by connecting the different types of metals in the falling section (3*b*), the space for connecting the different types of metals can be secured effectively.

The liquid pipe (32) and the gas pipe (33) each have a vertical section (a section provided in the second space (130*b*)) and a horizontal section (a section provided in the third space (130*c*)) formed by two bends (see FIG. 3). The horizontal section may change its inclined position when installed in the casing (130). In accordance with the change in the inclined position of the horizontal section, the vertical portions of the liquid pipe (32) and the gas pipe (33) may come into contact with each other, but the contact prevention member (40) can reduce contact between the vertical portions.

In FIGS. 5B, 6A, 7, 9, etc., the contact prevention member (40) is provided in the copper section of the connection pipe (3). This can effectively reduce damage to the relatively soft aluminum pipe by the relatively hard copper pipe in the approach area (C).

In FIGS. 5A, 6A, 9, 10, etc., the contact prevention member (40) is provided in the liquid pipe (32). In general, the liquid pipe (32) has a diameter smaller than that of the gas pipe (33). Accordingly, the contact prevention member (40) provided in the liquid pipe (32) can be downsized than the contact prevention member (40) provided in the gas pipe (33). As a result, the installation space for the connection pipe (3) can be reduced. In addition, the manufacturing costs of the connection pipe (3) can be reduced.

While the embodiments and the variations thereof have been described above, it will be understood that various changes in form and details may be made without departing from the spirit and scope of the claims (e.g., (1) to (5) below). The foregoing embodiment and variations thereof may be combined or replaced with each other without deteriorating the intended functions of the present disclosure. The ordinal numbers such as "first," "second," "third," in the description and claims are used to distinguish the terms to which these expressions are given, and do not limit the number and order of the terms.

(1) In this embodiment and the first to fifth variations, the liquid pipe (32) and the gas pipe (33) may be covered with an anti-dew cylinder for preventing dew condensation. In this case, the liquid pipe (32) and the gas pipe (33), which approach each other in the anti-dew cylinder, easily come into contact with each other. However, the contact prevention member (40) provided as in this embodiment and the first to fifth variations can effectively reduce contact between the liquid pipe (32) and the gas pipe (33) in the anti-dew cylinder.

(2) In this embodiment and the first to fifth variations, for example, the contact prevention member (40) may have a structure where both the liquid pipe (32) and the gas pipe (33) are inserted therein so that the contact prevention member (40) extends across the liquid pipe (32) and the gas pipe (33).

(3) In this embodiment and the first to fifth variations, the liquid pipe connector (32*c*) may be present inside the casing (130) (the first space (130*a*) or the second space (130*b*)), and the gas pipe connector (33*c*) may be present outside the casing (130) (the third space (130*c*)). In addition, the liquid pipe connector (32*c*) may be present outside the casing (130), and the gas pipe connector (33*c*) may be present inside the casing (130).

(4) In the liquid pipe (32), the first liquid pipe section (32*a*) and the second liquid pipe section (32*b*) may be connected to each other via a stainless steel pipe. In the gas pipe (33), the first gas pipe section (33*a*) and the second gas pipe section (33*b*) may be connected to each other via a stainless steel pipe. Accordingly, the contact prevention member (40) for preventing contact between the liquid pipe (32) and the gas pipe (33) is provided. This can reduce a contact area between the sections of the liquid pipe (32) and the gas pipe (33) made of different types of metals (copper and aluminum).

(5) In this embodiment and the first to fifth variations, the first liquid pipe parallel section (E11) to the second gas pipe parallel section (E22) are present in the falling section (3*b*). However, the present invention is not limited thereto. The first liquid pipe parallel section (E11) to the second gas pipe parallel section (E22) may be present in the lying section (3*c*). In this case, the contact prevention member (40) is provided in the lying section (3*c*). In addition, the first liquid pipe parallel section (E11) to the second gas pipe parallel section (E22) may be present in the connector (3*a*). In this case, the contact prevention member (40) is provided at the connector (3*a*).

INDUSTRIAL APPLICABILITY

As described above, the present disclosure is useful for an indoor unit of an air conditioner and the air conditioner.

DESCRIPTION OF REFERENCE CHARACTERS

3 Connection Pipe
3*b* Falling Section
10 Air Conditioner
13 Indoor Unit
30 Heat Exchanger
32 Liquid Pipe (First Connection Pipe)
33 Gas Pipe (Second Connection Pipe)
36 Heat Transfer Tube
40 Contact Prevention Member

The invention claimed is:

1. An indoor unit of an air conditioner, the indoor unit comprising:

a heat transfer tube of a heat exchanger;

a connection pipe which is connected to the heat transfer tube and through which a refrigerant flowing out of the heat transfer tube or a refrigerant flowing into the heat transfer tube passes, the connection pipe including a first connection pipe as a liquid pipe and a second connection pipe as a gas pipe, (i) the first connection pipe including a first section made of a first metal with no potential difference from the heat transfer tube, and the second connection pipe including a second section made of a second metal with a different potential from the first section, and (ii) the second connection pipe including a first section made of a first metal with no potential difference from the heat transfer tube, and the first connection pipe including a second section made of a second metal with a different potential from the first section, an insulating material for preventing contact between the first connection pipe and the second connection pipe being provided in an area where the second section of the first connection pipe and the first section of the second connection pipe are arranged side-by-side in parallel, or in an area where the first section of the first connection pipe and the second section of the second connection pipe are arranged side-by-side in parallel.

2. The indoor unit of claim 1, wherein the insulating material is provided at a place where the first connection pipe and the second connection pipe are parallel to each other.

3. The indoor unit of claim 1, wherein the first connection pipe and the second connection pipe each have a first section and a second section.

4. The indoor unit of claim 3, wherein the insulating material is provided on one of the first connection pipe and the second connection pipe.

5. The indoor unit of claim 1, wherein each of the first section and the second section of the first connection pipe and the second connection pipe are connected to each other, respectively, in a falling section of the connection pipe extending downward.

6. The indoor unit of claim 1, wherein the first section is made of aluminum or an aluminum alloy, the second section is made of copper or a copper alloy, and the insulating material is provided in the second section.

7. The indoor unit of claim 1, wherein the insulating material is provided in the first connection pipe.

8. The indoor unit of claim 1, wherein the insulating material extends across the first section and the second section.

9. The indoor unit of claim 1, wherein one of the first connection pipe and the second connection pipe includes a connector between the first section and the second section outside a casing of the indoor unit, and the other one of the first connection pipe and the second connection pipe includes a connector between the first section and the second section inside the casing of the indoor unit.

10. The indoor unit of claim 1, wherein the first section and the second section are connected to each other via a stainless steel pipe.

11. The indoor unit of claim 1, wherein the insulating material is a cylindrical member or a coating that covers a pipe.

12. The indoor unit of claim 1, wherein the first connection pipe and the second connection pipe are both covered with an anti-dew cylinder.

13. An air conditioner comprising:

the indoor unit of claim 1.

* * * * *